US007710224B2

(12) United States Patent
Gruner et al.

(10) Patent No.: US 7,710,224 B2
(45) Date of Patent: May 4, 2010

(54) ELECTROMAGNETIC RELAY ASSEMBLY

(75) Inventors: Philipp Gruner, Lakewood, IL (US); Klaus A. Gruner, Village of Lakewood, IL (US)

(73) Assignee: Clodi, L.L.C., Crystal Lake, IL (US)

( * ) Notice: Subject to any disclaimer, the term of this patent is extended or adjusted under 35 U.S.C. 154(b) by 128 days.

(21) Appl. No.: 11/888,519

(22) Filed: Aug. 1, 2007

(65) Prior Publication Data

US 2009/0033447 A1 Feb. 5, 2009

(51) Int. Cl.
*H01H 51/22* (2006.01)
*H01H 67/02* (2006.01)

(52) U.S. Cl. ..... 335/78; 335/83; 335/129; 335/130

(58) Field of Classification Search ..... 335/78, 335/83, 129–130
See application file for complete search history.

(56) References Cited

U.S. PATENT DOCUMENTS 5,568,108 A * 10/1996 Kirsch ..... 335/130
5,719,541 A * 2/1998 Mader ..... 335/78
5,933,065 A 8/1999 Duchemin
6,025,766 A * 2/2000 Passow ..... 335/78
6,046,660 A 4/2000 Gruner
6,046,661 A 4/2000 Reger et al.
6,246,306 B1 6/2001 Gruner
6,252,478 B1 6/2001 Gruner
6,320,485 B1 11/2001 Gruner
6,426,689 B1 * 7/2002 Nakagawa et al. ..... 335/78
6,563,409 B2 5/2003 Gruner
6,661,319 B2 * 12/2003 Schmelz ..... 335/78
6,788,176 B2 * 9/2004 Schmelz ..... 335/80
6,940,375 B2 * 9/2005 Sanada et al. ..... 335/86
2006/0279384 A1 * 12/2006 Takayama et al. ..... 335/78

* cited by examiner

*Primary Examiner*—Elvin G Enad
*Assistant Examiner*—Alexander Talpalatskiy
(74) *Attorney, Agent, or Firm*—Meroni & Meroni, P.C.; Charles F. Meroni, Jr.; Christopher J. Scott

(57) ABSTRACT

An electromagnetic relay enables current to pass through switch termini and comprises a coil assembly, a rotor or bridge assembly, and a switch assembly. The coil assembly comprises a coil and a C-shaped core. The coil is wound round a coil axis extending through the core. The core comprises core termini parallel to the coil axis. The bridge assembly comprises a bridge and an actuator. The bridge comprises medial, lateral, and transverse field pathways. The actuator extends laterally from the lateral field pathway. The core termini are coplanar with the axis of rotation and received intermediate the medial and lateral field pathways. The actuator is cooperable with the switch assembly. The coil creates a magnetic field directable through the bridge assembly via the core termini for imparting bridge rotation about the axis of rotation. The bridge rotation displaces the actuator for opening and closing the switch assembly.

33 Claims, 10 Drawing Sheets

ELECTROMAGNETIC RELAY ASSEMBLY

BACKGROUND OF THE INVENTION

1. Field of the Invention

The disclosed invention generally relates to an electromagnetic relay assembly incorporating a uniquely configured armature assembly. More particularly, the disclosed invention relates to an electromagnetic relay assembly having a magnetically actuable rotor assembly for linearly displacing a switch actuator.

2. Brief Description of the Prior Art

Generally, the function of an electromagnetic relay is to use a small amount of power in the electromagnet to move an armature that is able to switch a much larger amount of power. By way of example, the relay designer may want the electromagnet to energize using 5 volts and 50 milliamps (250 milliwatts), while the armature can support 120 volts at 2 amps (240 watts). Relays are quite common in home appliances where there is an electronic control turning on (or off) some application device such as a motor or a light. The present teachings are primarily intended for use as a single pole, 120-amp passing electromagnetic relay assembly. It is contemplated, however, that the essence of the invention may be applied in multi-pole relay assemblies, having unique construction and functionality as enabled by the teachings of the single pole embodiment set forth in this disclosure. Several other electromagnetic relay assemblies reflective of the state of the art and disclosed in United States patents are briefly described hereinafter.

U.S. Pat. No. 6,046,660 ('660 Patent), which issued to Gruner, discloses a Latching magnetic relay assembly with a linear motor. The '660 Patent teaches a latching magnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

U.S. Pat. No. 6,246,306 ('306 Patent), which issued to Gruner, discloses an Electromagnetic Relay with Pressure Spring. The '306 Patent teaches an electromagnetic relay having a motor assembly with a bobbin secured to a housing. A core is adjacently connected below the bobbin except for a core end, which extends from the bobbin. An armature end magnetically engages the core end when the coil is energized. An actuator engages the armature and a plurality of center contact spring assemblies. The center contact spring assembly is comprised of a center contact spring which is not pre bent and is ultrasonically welded onto a center contact terminal. A normally open spring is positioned relatively parallel to a center contact spring. The normally open spring is ultrasonically welded onto a normally open terminal to form a normally open outer contact spring assembly. A normally closed outer contact spring is vertically positioned with respect to the center contact spring so that the normally closed outer contact spring assembly is in contact with the center contact spring assembly, when the center contact spring is not being acted upon by the actuator. The normally closed spring is ultrasonically welded onto a normally closed terminal to form a normally closed assembly. A pressure spring pressures the center contact spring above the actuator when the actuator is not in use.

U.S. Pat. No. 6,252,478 ('478 Patent), which issued to Gruner, discloses an Electromagnetic Relay. The '478 Patent teaches an electromagnetic relay having a motor assembly with a bobbin secured to a frame. A core is disposed within the bobbin except for a core end which extends from the bobbin. An armature end magnetically engages the core end when the coil is energized. An actuator engages the armature and a plurality of movable blade assemblies. The movable blade assembly is comprised of a movable blade ultrasonically welded onto a center contact terminal. A normally open blade is positioned relatively parallel to a movable blade. The normally open blade is ultrasonically welded onto a normally open terminal to form a normally open contact assembly. A normally closed contact assembly comprised of a third contact rivet and a normally closed terminal. A normally closed contact assembly is vertically positioned with respect to the movable blade so that the normally closed contact assembly is in contact with the movable blade assembly when the movable blade is not being acted upon by the actuator.

U.S. Pat. No. 6,320,485 ('485 Patent), which issued to Gruner, discloses an Electromagnetic Relay Assembly with a Linear Motor. The '485 Patent teaches an electromagnetic relay capable of transferring currents of greater than 100 amps for use in regulating the transfer of electricity or in other applications requiring the switching of currents of greater than 100 amps. A relay motor assembly has an elongated coil bobbin with an axially extending cavity therein. An excitation coil is wound around the bobbin. A generally U shaped ferromagnetic frame has a core section disposed in and extending through the axially extending cavity in the elongated coil bobbin. Two contact sections extend generally perpendicularly to the core section and rises above the motor assembly. An actuator assembly is magnetically coupled to the relay motor assembly. The actuator assembly is comprised of an actuator frame operatively coupled to a first and a second generally U-shaped ferromagnetic pole pieces, and a permanent magnet. A contact bridge made of a sheet of conductive material copper is operatively coupled to the actuator assembly.

U.S. Pat. No. 6,563,409 ('409 Patent), which issued to Gruner, discloses a Latching Magnetic Relay Assembly. The '409 Patent teaches a latching magnetic relay assembly comprising a relay motor with a first coil bobbin having a first excitation coil wound therearound and a second coil bobbin having a second excitation coil wound therearound, both said first excitation coil and said second excitation coil being identical, said first excitation coil being electrically insulated from said second excitation coil; an actuator assembly magnetically coupled to both said relay motor, said actuator assembly having a first end and a second end; and one or two groups of contact bridge assemblies, each of said group of contact bridge assemblies comprising a contact bridge and a spring.

SUMMARY OF THE INVENTION

It is an object of the present invention to provide an electromagnetic relay assembly having certain means for damping contact vibration intermediate contacts of the switching assembly. It is a further object of the present invention to provide an armature assembly having an axis of rotation and which rotates under the influence of the magnetic field created or imparted from an electromagnetic coil assembly. The armature assembly linearly displaces a switch actuator for opening and closing the switch assembly of the relay. To achieve these and other readily apparent objectives, the electromagnetic relay assembly of the present disclosure comprises an electromagnetic coil assembly, an armature bridge assembly, and a switch assembly, as described in more detail hereinafter.

The coil assembly essentially comprises a coil, a C-shaped yoke assembly, and a coil axis. The coil is wound around the coil axis, and the yoke assembly comprises first and second yoke arms. Each yoke arm comprises an axial yoke portion that is coaxially alignable with the coil axis and together form the back of the C-shaped yoke assembly. Each yoke arm further, comprises a yoke terminus, which yoke termini are coplanar and substantially parallel to the coil axis.

The armature bridge assembly is rotatable about an axis orthogonally spaced from the coil axis and coplanar with the yoke termini. The armature bridge assembly thus comprises a bridge axis of rotation, a bridge, and an actuator arm. The bridge comprises a medial field pathway relative closer in proximity to the coil axis, a lateral field pathway relatively further in proximity to the coil axis, and longitudinally or axially spaced medial-to-lateral or lateral-to-medial field pathways (or transverse field pathways) extending intermediate the medial and lateral pathways. The actuator arm is cooperable with the lateral field pathway via a first end thereof and extends laterally away from the lateral field pathway.

The switch assembly essentially comprises switch terminals and a spring assembly between the switch terminals. The spring assembly is attached a second end of the actuator arm. The yoke termini are received intermediate the medial and lateral pathways. As is standard and well-established in the art, the coil receives current and creates or imparts a magnetic field, which magnetic field is directable through the bridge assembly via the yoke termini for imparting bridge rotation about the bridge axis of rotation and linearly displacing the actuator arm. The displaceable actuator arm functions to actuate the spring assembly intermediate an open contact position and a closed contact position, which closed contact position enables current to pass through the switch assembly via the switch termini.

Certain peripheral features of the essential electromagnetic relay assembly include certain means for enhancing spring over travel, which means function to increase contact pressure intermediate the switch terminals when the spring assembly is in the closed position. The means for enhancing spring over travel further provide means for contact wiping or contact cleansing via the enhanced contact or increased contact pressure. In other words, the enhanced conduction path through the contact interface may well function to burn off residues and/or debris that may otherwise come to rest at the contact surfaces. The means for enhancing spring over travel may well further function to provide certain means for damping contact bounce or vibration intermediate the first and second contacts when switching from the open position to the closed position.

Other objects of the present invention, as well as particular features, elements, and advantages thereof, will be elucidated or become apparent from, the following description and the accompanying drawing figures.

BRIEF DESCRIPTION OF THE DRAWINGS

Other features of our invention will become more evident from a consideration of the following brief description of patent drawings.

DETAILED DESCRIPTION OF THE PREFERRED EMBODIMENT

Figure 1:
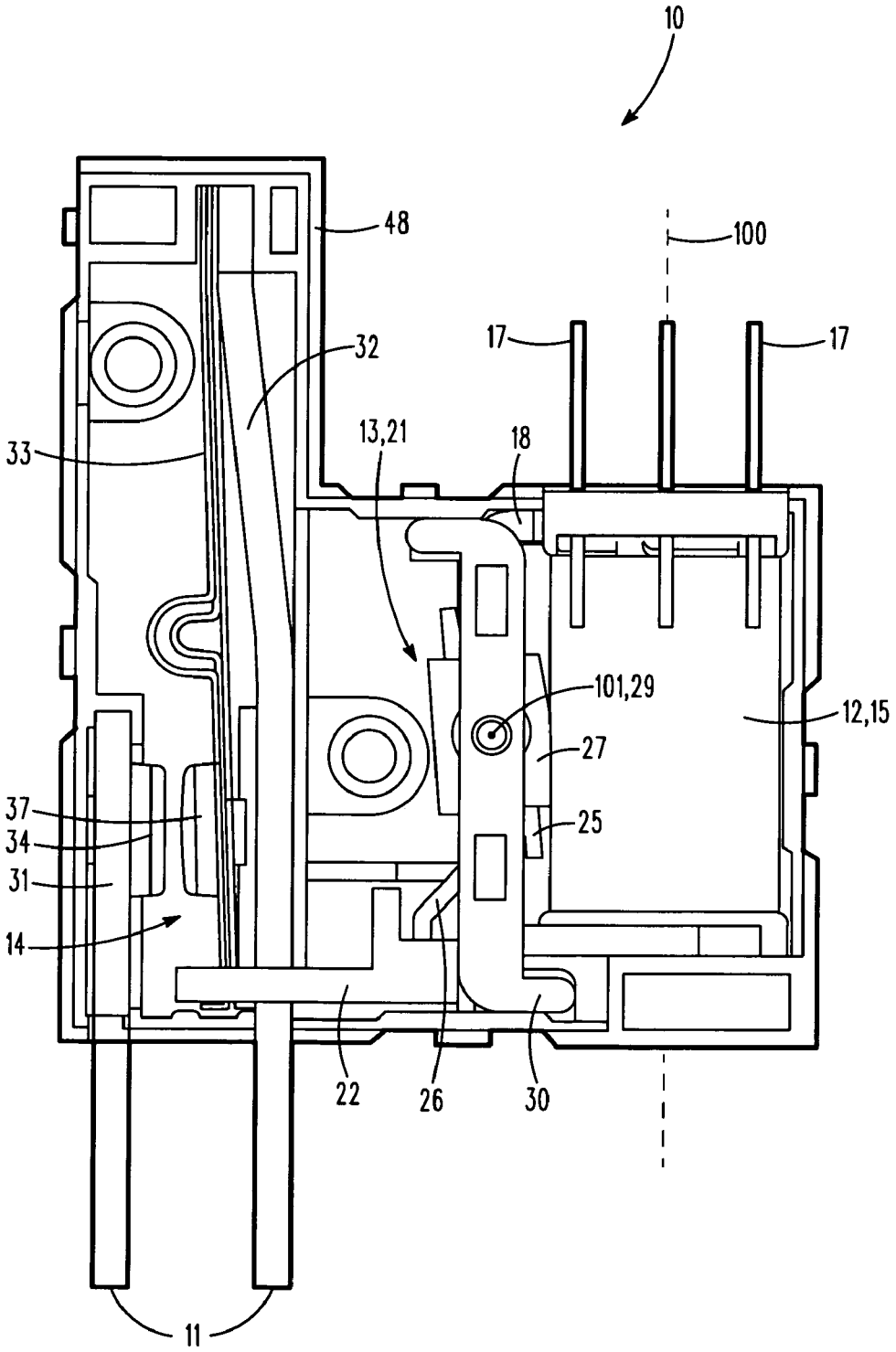
FIG. 1 is a top plan view of the electromagnetic relay assembly of the present invention with the switch assembly in an open position.
Figure 2:
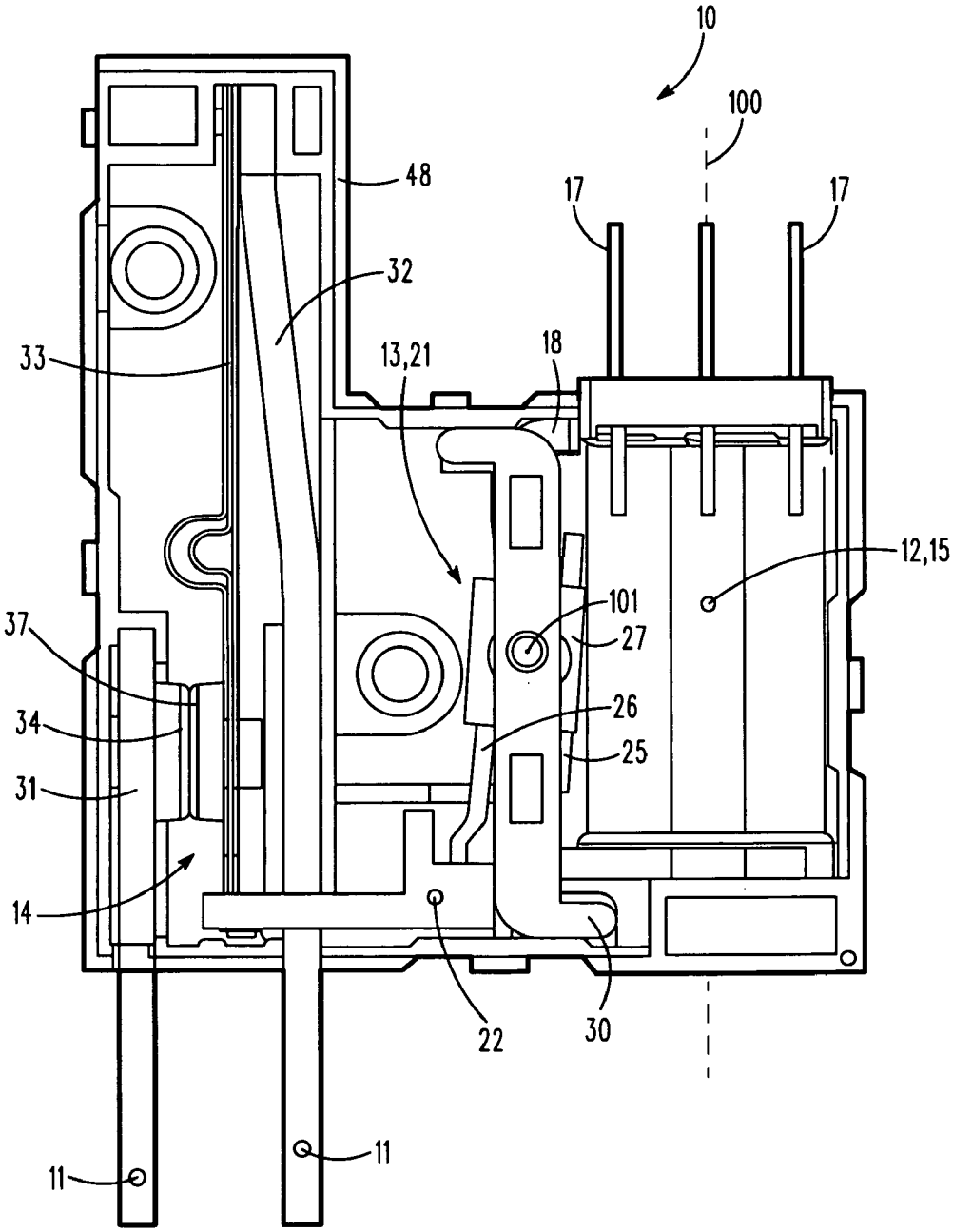
FIG. 2 is a top plan view of the electromagnetic relay assembly of the present invention with the switch assembly in a closed position.
Figure 3:
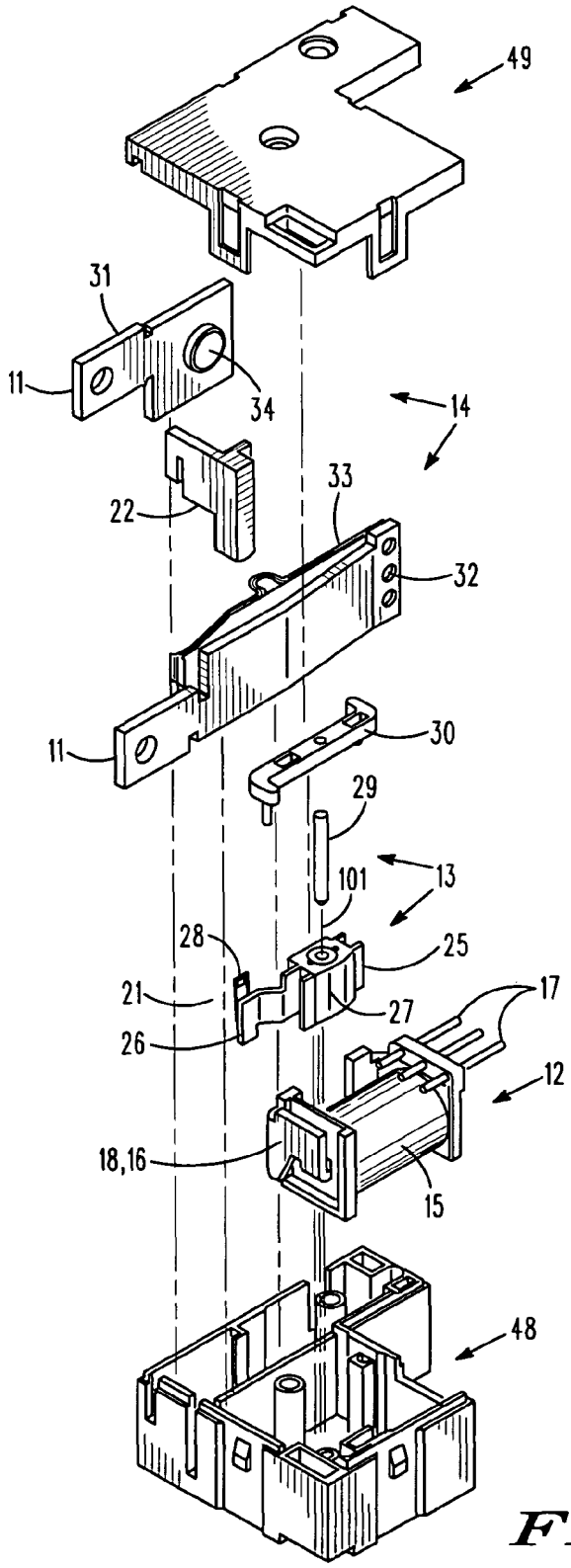
FIG. 3 is a top perspective exploded type depiction of the electromagnetic relay assembly of the present invention with showing an optional housing cover.
Figure 4:
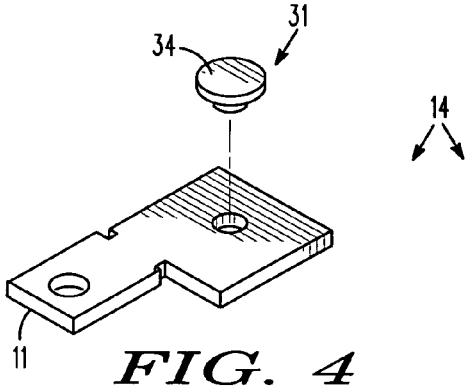
FIG. 4 is an exploded perspective view of a first terminal assembly of the switch assembly of the electromagnetic relay assembly.
Figure 5:
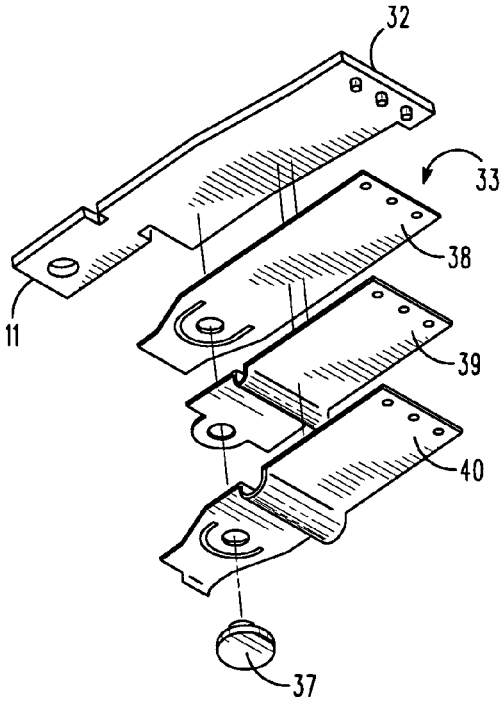
FIG. 5 is an exploded perspective view of a second terminal assembly of the switch assembly of the electromagnetic relay assembly.

Referring now to the drawings, the preferred embodiment of the present invention concerns an electromagnetic relay assembly 10 as illustrated and referenced in FIGS. 1-3. The electromagnetic relay assembly 10 of the present invention essentially functions to selectively enable current to pass through switch termini 11 as illustrated and referenced in FIGS. 1-5. To achieve these and other readily apparent functions, the electromagnetic relay assembly 10 of the present invention preferably comprises an electromagnetic coil assembly 12 as generally illustrated and referenced in FIGS. 1-3, and 6; a rotatable armature assembly 13 as generally illustrated and referenced in FIGS. 1-3; and a switch assembly 14 as generally illustrated and referenced in FIGS. 1-5.

Figure 6:
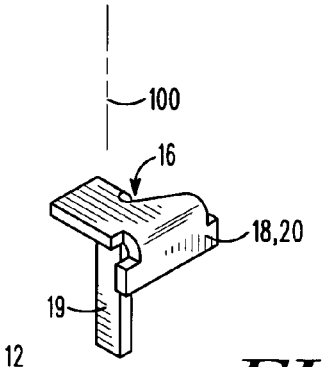
FIG. 6 is an exploded perspective view of a coil assembly of the electromagnetic relay assembly of the present invention.
Figure 12:
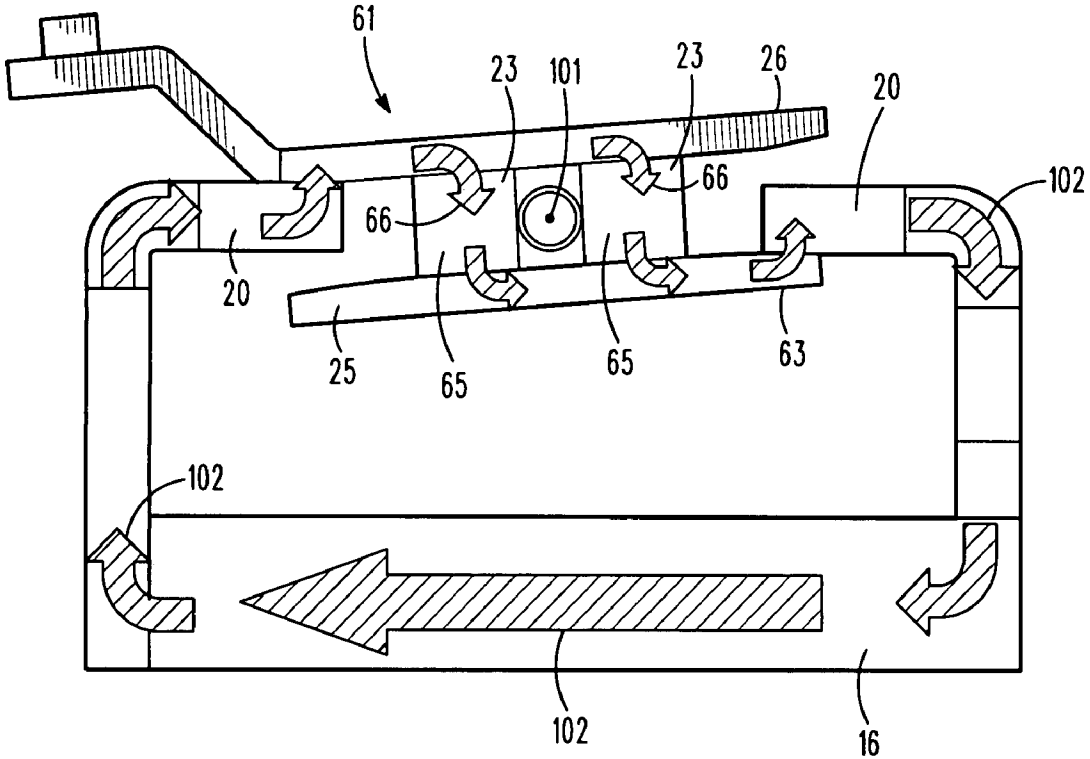
FIG. 12 is a diagrammatic depiction of the flux flow through the C-shaped core assembly and the rotor assembly of the electromagnetic relay assembly depicting a diverted and divided field flow through the rotor assembly.
Figure 13:
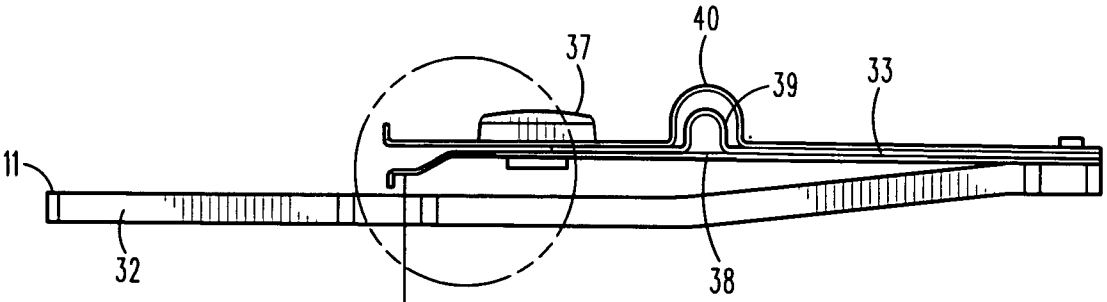
FIG. 13 is a side view depiction of a switch terminal assembly as operatively connected to a triumvirate spring assembly and a contact button, the triumvirate spring assembly showing first and second springs with centrally located C-shaped folds, and a third spring with an end-located bend.
Figure 14:
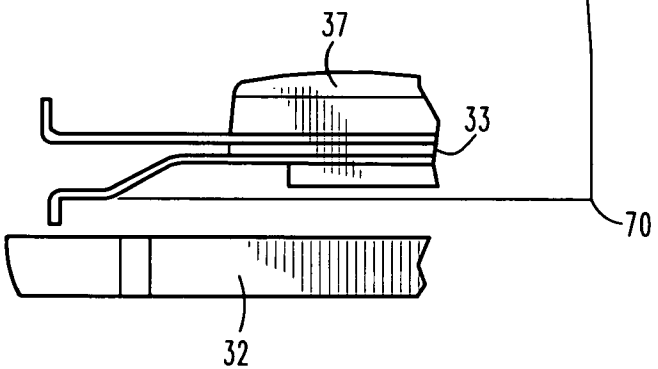
FIG. 14 is an enlarged fragmentary sectional view as taken from FIG. 13 depicting the end-located bend of the third spring in rater detail.

The coil assembly 12 of the present invention preferably comprises a current-conductive coil 15 as illustrated and referenced in FIGS. 1-3, and 6; a C-shaped core or yoke assembly 16 as illustrated and referenced in FIGS. 3, 6, and 12; and a coil axis 100 generally referenced and depicted in FIGS. 1, 2, 6, and 12. It may be seen or understood from an inspection of the noted figures that the current-conductive coil 15 is wound around the coil axis 100 and comprises first and second electromagnet-driving termini 17 as illustrated and referenced in FIGS. 1-3, and 6. The yoke assembly or C-shaped core assembly 16 of the present invention is axially received within the coil 15 and preferably comprises first and second yoke arms 18, one of which is illustrated and referenced in FIGS. 1-3, and both of which are illustrated and referenced in FIG. 6. It may be seen from an inspection of FIG. 6 that yoke arms 18 each comprise an axial yoke portion 19 and a substantially planar yoke terminus 20, which yoke termini 20 are preferably parallel to the coil axis 100 as further referenced and depicted in FIG. 12.

Figure 7:
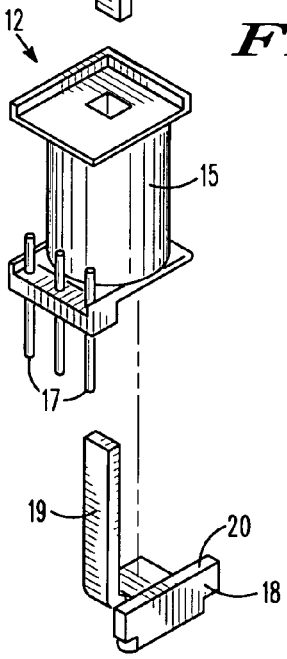
FIG. 7 is an exploded fragmentary perspective view of a rotor assembly of the armature assembly of the electromagnetic relay assembly.
Figure 7:
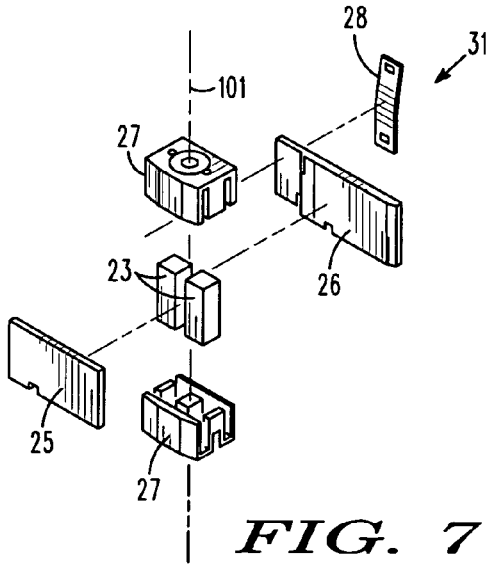

It is contemplated that the rotatable armature assembly 13 of the present invention may be described as preferably comprising a rotor assembly 21 as generally illustrated and referenced in FIGS. 1-3, and 7; an actuator or actuator arm 22 as generally illustrated and referenced in FIGS. 1-3, 9, and 10; and an armature axis of rotation 101 as depicted and referenced at a point in FIGS. 1, 2, 12, and 15, and as a line in FIGS. 3 and 7. The rotor assembly 21 preferably comprises first and second uniformly directed or polarized rotor magnets 23 as illustrated and referenced in FIGS. 7 and 12; a rotor plate 25 as illustrated and referenced in FIGS. 1-3, 7, and 12; a rotor bracket as generally illustrated in FIGS. 1-3, and 12 and referenced at number 26; a rotor housing 27 as illustrated and referenced in FIGS. 1-3, and 7; a return spring 28 as illustrated and referenced in FIGS. 3 and 7; a rotor pin 29 as illustrated and referenced in FIGS. 1 and 3; and a rotor mount 30 as illustrated and referenced in FIGS. 1-3.

It may be seen from an inspection of the noted figures that the rotor bracket 26 is attached or otherwise cooperatively associated with first ends of the actuator arms 22, and that the rotor plate 25 and the rotor bracket 26 (or portions thereof) are preferably oriented parallel to one another by way of the rotor housing 27. It will be seen that a terminal end of the rotor bracket 26 is zigzagged or zigzag-extended from the central portion of the rotor bracket 26, which central portion is parallel to the rotor plate 25. The terminal end of the rotor bracket 26, as zigzag extended from, and integrally formed with the rotor bracket 26, attaches the rotor bracket 26 to the actuator arms 22.

It may be further seen that the first and second rotor magnets 23 are equally dimensioned and extend intermediate the rotor plate 25 and the central portion of the rotor bracket 26 for simultaneously and equally spacing the rotor plate 25 and the central portion of the rotor bracket 26 and for further providing a guide way or pathway for so-called Lorenz current or magnetic flux to be effectively transversely directed across the rotor or bridge assembly 21 as diagrammatically depicted in FIG. 12.

In this last regard, it is contemplated that the armature assembly 13 may be thought of as an armature bridge assembly, which bridge assembly comprises a bridge axis of rotation (akin to the armature axis of rotation 101) and a bridge in cooperative association with the armature arm 22. In this context, the bridge may be thought of or described as preferably comprising a medial pathway (akin to the rotor plate 25), a lateral pathway (akin to the rotor bracket 26), and longitudinally or axially spaced medial-to-lateral or transverse pathways (akin to the first and second rotor magnets 23. The armature arm 22 may thus be described as extending laterally away from the lateral pathway or rotor bracket 26 for engaging the switch assembly 14.

The rotor housing 27 essentially functions to receive, house, and position the first and second rotor magnets 23, the rotor plate 25 and the rotor bracket 26 to form the bridge like structure of the armature assembly 13. The rotor magnets 23 are uniformly directed such that like poles face the same rotor structure. For example, it is contemplated that the north poles of rotor magnets 23 may face the rotor bracket 26 (the south poles thereby facing the rotor plate 25) or that the south poles of rotor magnets 23 may face the rotor bracket 26 (the north poles thereby facing the rotor bracket).

The rotor housing 27 may well further comprise a pin-receiving aperture or bore for receiving the rotor pin 29 as may be generally seen from an inspection of FIGS. 3 and 7. The pin-receiving aperture or bore of the rotor housing 27 enables rotation of the bridge or armature assembly 13 about the armature axis of rotation 101. The rotor pin 29, extending through the pin-receiving bore, may be axially anchored at a lower end thereof by way of a relay housing 48 as illustrated and referenced in FIGS. 1-3, and which relay housing 48 is sized and shaped to receive, house, and position the coil assembly 12, the armature assembly 13, and the switch assembly 14 as may be readily understood from an inspection of FIG. 3. It may be further readily understood from an inspection of FIG. 3 that the relay housing 48 may, but not necessarily, comprise or be cooperable with a relay cover 49.

In this last regard, it will be recalled that the armature assembly 13 of present invention may be anchored or mounted by way of the rotor mount 30. Rotor mount 30 may be cooperatively associated with the relay housing 48 (i.e. anchored to the relay housing 48) for axially fixing the rotor pin 29, the fixed rotor mount 30 receiving and anchoring an upper end of the rotor pin 29 so as to enable users of the relay to effectively operate the electromagnetic relay assembly 10 of the present invention without the relay cover 49. The rotor mount 30 or bridge mount or means for mounting the rotor assembly or bridge assembly may thus be described as providing certain means for enabling open face operation of the electromagnetic relay assembly 10. It is contemplated, for example, that in certain scenarios a coverless relay assembly provides a certain benefit. For example, the subject relay assembly may be more readily observed during testing procedures. In any event, it is contemplated that the rotor mount 30 of the present invention enables cover-free operation of the electromagnetic relay assembly 10 by otherwise fixing the armature assembly 13 to the relay housing 48.

The switch assembly 14 of the present relay assembly 10 preferably comprises a first switch terminal assembly 31 as generally illustrated and referenced in FIGS. 1-4; and a second switch terminal assembly 32 as illustrated and referenced in FIGS. 1-3, 5, 13, and 14; and a triumvirate spring assembly 33 as illustrated and referenced in FIGS. 1-3, 5, 8-11, 13, and 14. From an inspection of the noted figures, it may be seen that the first switch terminal assembly 31 preferably comprises a first contact button 34 and a first switch terminus as at 11. Further, the second switch terminal assembly 32 preferably comprises a second switch terminus as at 11.

The triumvirate spring assembly 33 preferably comprises a second contact button 37 as illustrated and referenced in FIGS. 1, 2, 9-11, 13, and 14; and a first spring 38, second spring 39, and third spring 40 as further illustrated and referenced in FIGS. 5, 8-10, and 13. It may be further seen that the first spring 38 preferably comprises a first contact-receiving aperture as at 41 and a first C-shaped aperture as at 42 in FIG. 8, as well as an end-located offset or bend as at 70 in FIGS. 13 and 14. Notably, the first C-shaped aperture 42 is preferably concentric about the first contact-receiving aperture 41. The second spring 39 preferably comprises a second contact-receiving aperture as at 43 and a first C-shaped fold as at 44 in FIG. 8. It may be seen from an inspection of FIG. 8 that the first C-shaped fold 44 has a certain first radius of curvature. The third spring 40 preferably comprises a third contact-receiving aperture as at 45, a second C-shaped aperture as at 46, and a second C-shaped fold as at 47.

It may be further seen that the second C-shaped aperture 46 is preferably concentric about the third contact-receiving aperture 45, and that the second C-shaped fold 47 has a certain second radius of curvature, which second radius of curvature is greater in greater in magnitude than the first radius of curvature (of the first C-shaped fold 44). The second spring 39 is sandwiched intermediate the first and third springs 38 and 40 via the second contact button 37 as received or extended through the contact-receiving apertures 41, 43, and 45. The first C-shaped fold 44 is concentric (about a fold axis) within the second C-shaped fold 47. The first and second contact buttons 34 and 37 or contacts are spatially oriented or juxtaposed adjacent one another as generally depicted in FIGS. 1, 2, 9, and 10. In the preferred embodiment, the triumvirate spring assembly 33 is biased in an open contact position intermediate the first and second switch termini 11 and attached to (the lateral end of) the armature arm 22 as perhaps mostly clearly depicted in FIGS. 9 and 10.

It is contemplated that the first and second C-shaped apertures 42 and 46, and the end-located offset or bend 70 may well function to provide certain means for enhanced over travel for increasing contact pressure intermediate the first and second contact buttons 34 and 37. In this regard, the reader is further directed to FIGS. 9 and 10. From a comparative consideration of the noted figures, it may be seen that the terminal side ends 53 of the spring assembly 33 may be actuated past the planar portions of the spring assembly immediately adjacent the stem 51 of contact button 37. The planar portions of the spring assembly immediately (and radially) adjacent the stem 51 of contact button 37 thus form button-stackable spring portions or semi-circular, aperture-defining extensions as referenced at 52 in FIGS. 8 and 11. From an inspection of FIGS. 8 and 11, it may be seen that the button-stackable portions 52 stack upon the contact button 37 and that terminal side ends 53 of the elastically deform as at 50 for enabling said over travel.

Figure 8:
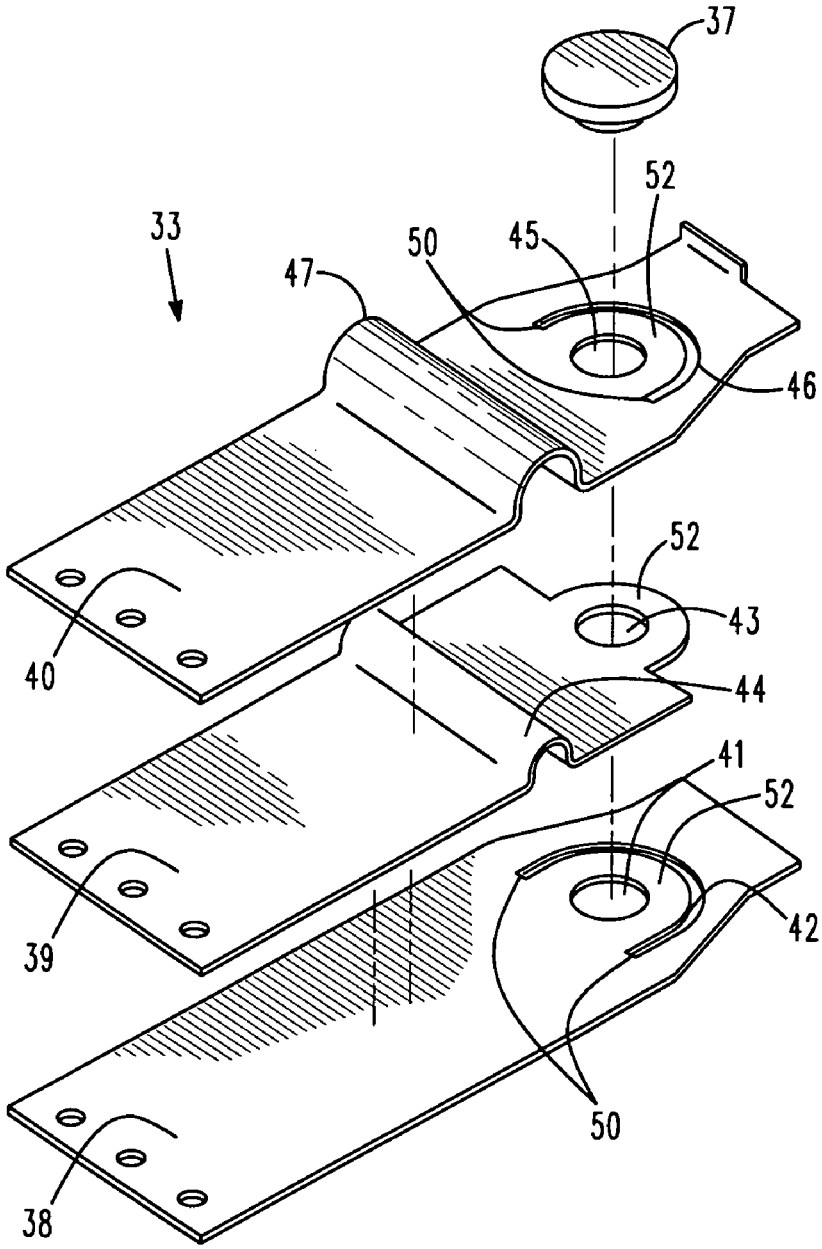
FIG. 8 is an exploded perspective view of the triumvirate spring assembly and a contact button of the switch assembly of the electromagnetic relay assembly.
Figure 9:
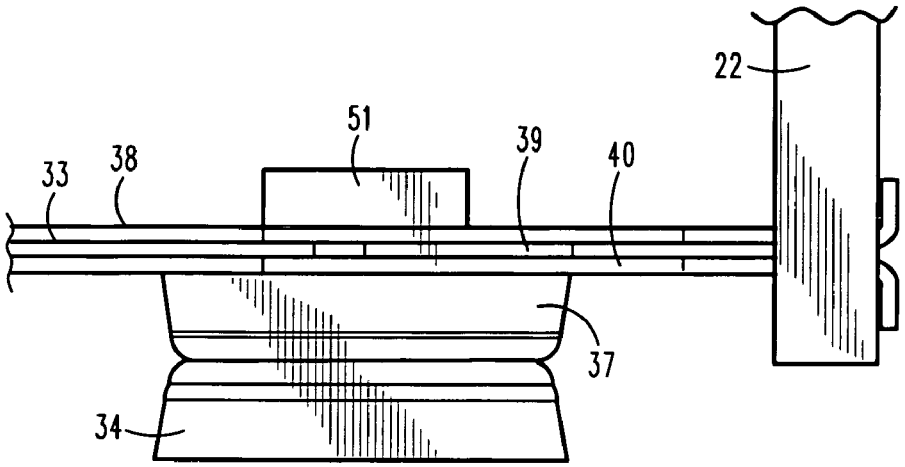
FIG. 9 is a fragmentary side view depiction of the triumvirate spring assembly, the contact buttons, and the armature arm of the present invention showing the contact buttons in a closed position with the triumvirate spring assembly in a substantially coplanar position.

In other words, the material (preferably copper) of the spring elements having the C-shaped apertures is more readily and elastically deformable at the termini of the C-shaped apertures as at 50 in FIG. 8. Notably, the elastic deformation of the material adjacent termini 50 does not result in appreciable embrittlement of the underlying material lattice (i.e. does not appreciably impart undesirable lattice dislocations) and thus the C-shaped aperture structure or feature of the triumvirate spring assembly provides a robust means for enhanced over travel for further providing a certain added pressure intermediate the contact buttons 34 and 37 for improving conductive contact(s) therebetween. The end-located offset or bend 70 further provides a means for enhanced overtravel for increasing contact pressure and reducing contact bounce of the contacts 34 and 37.

Figure 10:
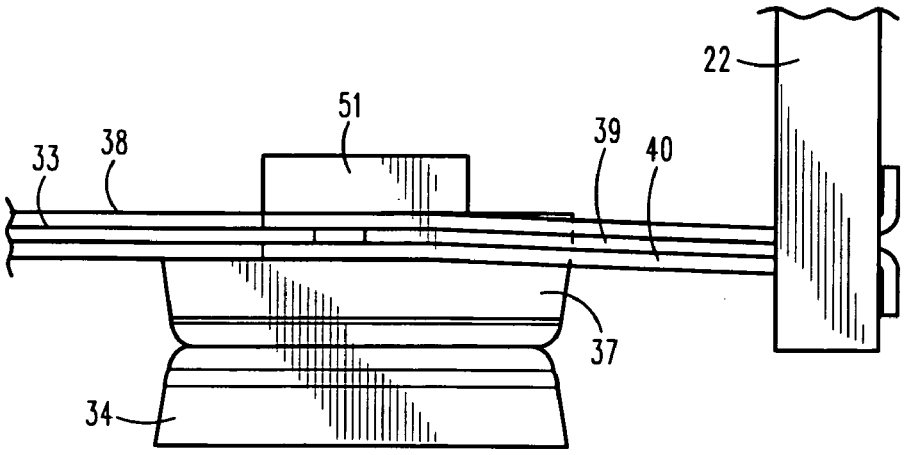
FIG. 10 is a fragmentary side view depiction of the triumvirate spring assembly, the contact buttons, and the armature arm of the present invention showing the contact buttons in a closed position with the triumvirate spring assembly in an over travel position for enhancing contact pressure intermediate the contact buttons.

Conduction through the contact buttons 34 and 37 is thus improved by way of the C-shaped aperture-enabled and/or enhanced over travel as generally depicted in FIG. 10. It is contemplated that the enhanced contact and resulting conduction provides certain means for improved contact wiping, the means for contact wiping or contact cleansing thus being further enabled by way of the enhanced over travel. In this regard, it is contemplated that the relay assembly 10 of the present invention inherently has a self-cleansing feature as enabled by the C-shaped apertures 42 and 46. Further, it is contemplated that the C-shaped apertures 42 and 46 (and offset or bend 70) may well provide certain means for reducing contact bounce or for otherwise damping contact vibration intermediate the contact buttons 34 and 37 when switching from an open contact state or open switch position (as generally depicted in FIG. 1) to a closed contact state or closed switch position (as generally depicted in FIG. 2).

From an inspection of FIG. 12, it may be readily understood that the core or yoke termini 20 are loosely received intermediate the rotor plate 25 and the rotor bracket 26, and that the armature axis of rotation 101 is coplanar with the yoke termini 20, which axis of rotation 101 extends through the rotor pin 29 (not specifically depicted in FIG. 20). As should be readily understood, the current-conductive coil 15 functions to receive current and thereby creates a magnetic field as further depicted and referenced at vectors 102 in FIG. 12. As may be seen from an inspection of the noted figure, the magnetic field 102 is directed through the yoke termini 20 via the rotor assembly (essentially defined by the rotor bracket 26, the rotor magnets 23, and the rotor plate 25) for imparting armature or bridge rotation about the armature axis of rotation 101 via a magnetically induced torque.

Figure 11:
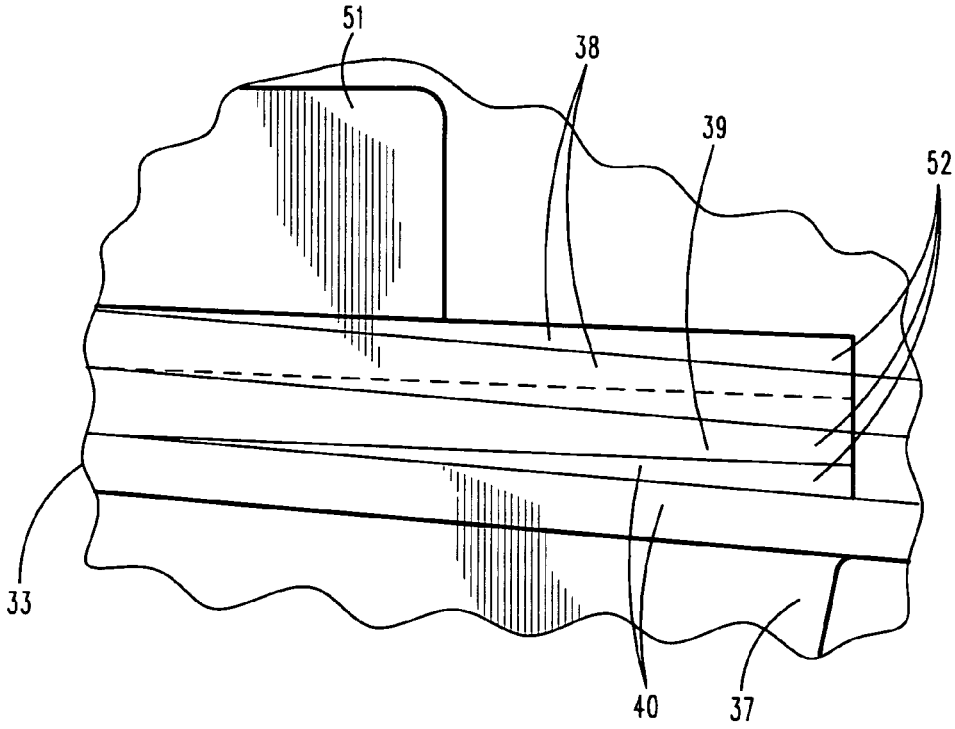
FIG. 11 is an enlarged fragmentary side view depiction of the junction at the triumvirate spring assembly and the upper contact button otherwise shown in FIG. 10 depicting the triumvirate spring assembly in the over travel position for enhancing contact pressure intermediate the contact buttons.

The rotor bracket 26 thus functions to linearly displace the actuator arm 22, which displaced actuator arm 22 functions to actuate the triumvirate spring assembly 33 from a preferred spring-biased open position (as generally depicted in FIG. 1) to a spring-actuated closed position (as generally depicted in FIG. 2). The material construction of the relay assembly 10 (believed to be within the purview of those skilled in the art) and the closed position essentially function to enable 120-amp current to pass through the switch assembly 14 via the first and second contact buttons 34 and 37 and the switch termini 11. When the coil assembly 12 is currently dormant and the magnetic field is effectively removed, the return spring 28 may well function to enhance return of the triumvirate spring assembly 33 to the preferred spring-biased open position as generally depicted in FIG. 11. Should a fault current condition arise, it is contemplated that the electromagnetic relay 10 may preferably further comprise certain closed contact default means, the closed contact default means for forcing the first and second contact buttons 34 and 37 closed during said fault current or short circuit condition (s). In this regard, it is contemplated that the path followed by the Lorenz current or magnetic field path as generally depicted in FIG. 12 by vector arrows 102.

It is further contemplated that the electromagnetic relay according to the present invention may comprise certain means for defaulting to an open contact position during threshold terminal-based current conditions. In this regard, it is noted from classical electromagnetic theory that streaming charge carriers develop a magnetic field in radial adjacency to the direction of the carrier stream. The reader is thus directed to FIG. 15 which is a diagrammatic depiction of a threshold current path as at 71 being directed through the relay terminals 31 and 32 via the contact buttons 34 and 37. A magnetic force vector as at 103 is depicted as terminal-sourced via the charge carrier current flowing through the path 71. After reaching certain threshold amperage, the magnetic field generated through the terminals 31 and 32 will interact with the permanent magnets or rotor magnets 23 of the rotatable armature assembly 13. The magnets 23 have an inherent magnetic field directed outward as referenced at vector arrow 104, the force of which is lesser in magnitude than the force at vector arrow 103. The difference in force between 104 and 103 as directed causes the rotatable armature assembly 13 to rotate toward an open contact position as diagrammatically shown in FIG. 15. This feature can be calibrated by the size and strength of the magnets 23 and the distance between the armature and stationary contacts.

While the above descriptions contain much specificity, this specificity should not be construed as limitations on the scope of the invention, but rather as an exemplification of the invention. For example, the invention may be said to essentially teach or disclose an electromagnetic relay assembly for enabling current to pass through switch termini, which electromagnetic relay assembly comprising a coil assembly, a bridge assembly, and a switch assembly. The coil assembly comprises a coil, a coil axis, and a C-shaped core. The coil is wound around the coil axis 100, and the coil axis extends 100 through the core as at 60 in FIG. 12. The core 60 comprises core termini 20, which core termini 20 are substantially parallel to the coil axis 100.

Figure 15:
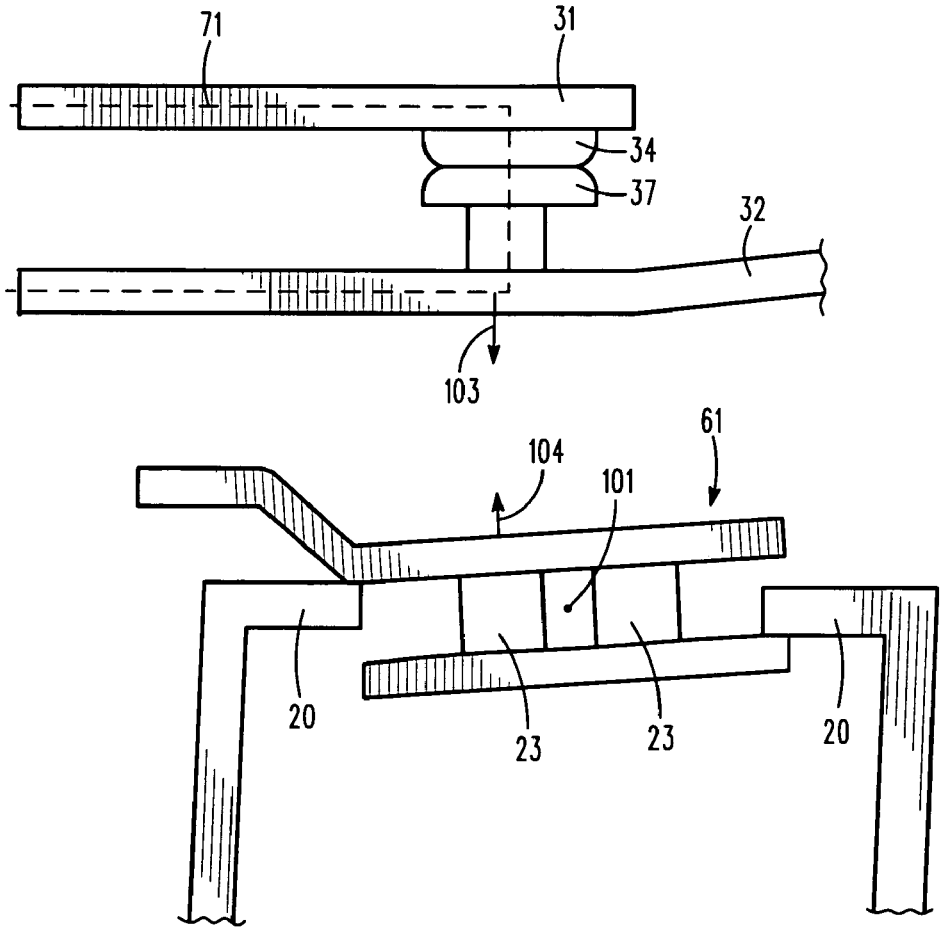
FIG. 15 is a diagrammatic depiction of a threshold current path directed through the relay terminals as disposed in adjacency to the-rotatable armature assembly and depicting a terminal-sourced magnetic field greater in magnitude than an armature-sourced magnetic field for rotating the armature assembly toward a circuit-opening position.

The bridge assembly comprises an axis of rotation as at 101 and a bridge as at 61 in FIGS. 12 and 15; and a switch actuator as at 22. The bridge 61 comprises a medial field pathway 63 (i.e. a pathway relatively closer in proximity to the core 60), a lateral field pathway 64 (i.e. a pathway relatively further in proximity to the core 60), and axially spaced transverse pathways 65 for guiding the field as at 102 intermediate the medial and lateral field pathways 63 and 64. The actuator arm 22 is cooperable with, and extends away from, the lateral pathway 64 (not specifically depicted in FIG. 12). The core termini 20 are preferably coplanar with the axis of rotation 101 and received intermediate the medial and lateral pathways 63 and 64.

It is contemplated that the transverse pathways 65 provide certain field-diversion means for transversely diverting the magnetic field 102 relative to the coil axis 100 and magnetically inducing a torque, which magnetically induced torque functions to actuate the switch actuator 22. Said field diversion means may be further described as comprising certain field division means (there being two axis-opposing paths as at 66 in FIG. 12) for creating a magnetic couple about the magnetically induced torque.

The switch assembly as at 14 is further cooperable with the actuator arm 22, which actuator arm 22 is essentially a coupling intermediate the bridge assembly 61 and the switch assembly 14. The coil functions to create or impart a magnetic field as vectorially depicted at 102. The magnetic field 102 is directable through the bridge assembly 61 via the core termini 20 for imparting bridge rotation about the axis of rotation 101 via magnetically induced torque. The bridge rotation functions to displace the actuator arm 22, which displaced actuator arm 22 physically opens and closes the switch assembly 14. As is most readily understood in the arts, the closed switch assembly 14 enables current to pass therethrough.

The switch assembly 14 comprises certain spring means for enhancing spring over travel, said means for enhancing the closed switch position by way of increasing the contact pressure intermediate contact buttons 34 and 37. The spring means for enhancing spring over travel further provide contact wiping means, and vibration damping means. The contact wiping means are contemplated to effectively self-cleanse the switch assembly 14, and the vibration damping means function to damp contact vibration when switching from open to closed switch positions. The spring means for enhancing spring over travel may thus be said to enhance the closed switch position by increasing contact pressure intermediate the contacts, by maintaining a residue free contact interface, and by damping contact vibration when closing the contacts.

Although the invention has been described by reference to a number of embodiments it is not intended that the novel device or relay be limited thereby, but that modifications thereof are intended to be included as falling within the broad scope and spirit of the foregoing disclosure and the appended drawings. For example, the foregoing specifications support an electromagnetic relay assembly primarily intended for use as a single pole, 120-amp passing relay assembly. It is contemplated, however, that the essence of the invention may be applied in multi-pole relay assemblies, having unique construction and functionality in their own right, but which are enabled by the teachings of the single pole embodiment set forth in this disclosure.

We claim:

1. An electromagnetic relay assembly, the electromagnetic relay assembly for selectively enabling current to pass through switch termini, the electromagnetic relay assembly comprising:

an electromagnetic coil assembly, the coil assembly comprising a current-conductive coil, a yoke assembly, and a coil axis, the coil being wound around the coil axis and comprising first and second electromagnet-driving termini, the yoke assembly comprising first and second yoke arms, the yoke arms each comprising an axial yoke portion and a yoke terminus;

an armature assembly, the armature assembly comprising a rotor assembly and a rotor axis of rotation, the rotor assembly comprising first and second rotor magnets, a rotor plate, and an actuator assembly, the actuator assembly comprising a rotor bracket and an actuator, the rotor bracket comprising a terminal end, the terminal end extending laterally from the rotor assembly substantially parallel to the rotor plate, the rotor magnets having like orientation and extending intermediate the rotor plate and the rotor bracket opposite the rotor axis of rotation; and a switch assembly, the switch assembly comprising first and second switch terminals and a triumvirate spring assembly, the first switch terminal comprising a first contact and a first switch terminus, the second switch terminal comprising a second switch terminus, the spring assembly comprising a second contact and three spring elements, a first spring element comprising a first C-shaped aperture, the first C-shaped aperture defining a first semi-circular aperture-defining extension, the first C-shaped aperture being concentric about the first contact-receiving aperture, the second spring element comprising a second contact-receiving aperture and terminating in a second semi-circular aperture-defining extension, the third spring element comprising a third contact-receiving aperture and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the first and second contacts being juxtaposed adjacent one another, the spring assembly being attached to the actuator, the yoke termini being received intermediate the rotor plate and the rotor bracket, the rotor axis of rotation being coplanar with the yoke termini, the rotor bracket and terminal end extending non-radially relative to the rotor axis of rotation, the laterally extended terminal end for introducing spring-based damping means intermediate the rotor bracket and actuator, the coil for creating a magnetic field, the magnetic field being directable through the yoke termini via the rotor assembly for imparting armature rotation about the rotor axis of rotation, the rotor bracket with the terminal end for displacing the actuator, the actuator for actuating the spring assembly intermediate an open position and a closed position, the closed position for enabling current to pass through the switch assembly via the first and second contacts and the switch termini.

2. The electromagnetic relay assembly of claim 1 wherein the C-shaped apertures provide means for enhanced spring over travel, the enhanced spring over travel for increasing contact pressure intermediate the first and second contacts when the spring assembly is in the closed position.

3. The electromagnetic relay assembly of claim 2 wherein the means for enhanced spring over travel provide means for contact wiping, the means for contact wiping for cleansing the first and second contacts.

4. The electromagnetic relay assembly of claim 1 wherein the C-shaped apertures provide means for damping contact vibration intermediate the first and second contacts when switching from the open position to the closed position.

5. The electromagnetic relay assembly of claim 1 wherein the rotor assembly comprises a return spring, the return spring for enhancing return of the spring assembly to the open position when the coil is dormant.

6. The electromagnetic relay assembly of claim 1 comprising rotor mounting means, the rotor mounting means for enabling open face operation of the electromagnetic relay.

7. The electromagnetic relay assembly of claim 1 comprising closed contact default means, the closed contact default means for forcing the first and second contacts to the closed position during fault current conditions.

8. The electromagnetic relay of claim 1 comprising means for defaulting to an open contact position during threshold terminal-based current conditions.

9. An electromagnetic relay, the electromagnetic relay for enabling current to pass through switch termini, the electromagnetic relay comprising:

an electromagnetic coil assembly, the coil assembly comprising a coil, a C-shaped yoke assembly, and a coil axis, the coil being wound around the coil axis, the yoke assembly comprising first and second yoke arms, the yoke arms each comprising an axial yoke portion and a yoke terminus;

an armature bridge assembly, the armature bridge assembly comprising a bridge axis of rotation, a bridge, and an actuator assembly, the bridge comprising a medial field pathway, a lateral field pathway, and longitudinally spaced transverse field pathways, the actuator assembly comprising a rotor bracket, the rotor bracket comprising a terminal end, the terminal end zigzag extending laterally from the bridge assembly non-orthogonally relative to the medial and lateral field pathways; and a switch assembly, the switch assembly comprising switch terminals and a spring assembly, the spring assembly being attached to the actuator assembly and extending intermediate the switch terminals, the yoke termini being received intermediate the medial and lateral field pathways, the bridge axis of rotation being coplanar with the yoke termini, the coil for receiving current and creating a magnetic field, the magnetic field being directable through the bridge assembly via the yoke termini for imparting bridge rotation about the bridge axis of rotation and displacing the actuator assembly via the terminal end, the laterally extended terminal end for introducing spring-based damping means intermediate the rotor bracket and actuator assembly, the displaceable actuator assembly for actuating the spring assembly intermediate an open contact position and a closed contact position, the closed contact position for enabling current to pass through the switch assembly via the switch termini.

10. The electromagnetic relay of claim 9 comprising spring-based aperture means for enhancing spring over travel, said means for increasing contact pressure intermediate the switch terminals when the spring assembly is in the closed contact position.

11. The electromagnetic relay of claim 10 wherein the spring-based aperture means for enhancing spring over travel provide means for contact wiping, said means for cleansing the switch terminals.

12. The electromagnetic relay of claim 9 comprising spring-based aperture means for damping contact vibration intermediate the first and second contacts when switching from the open contact position to the closed contact position.

13. The electromagnetic relay of claim 9 comprising bridge-mounting means, the bridge-mounting means for enabling open face operation of the electromagnetic relay.

14. The electromagnetic relay of claim 9 comprising means for defaulting to a closed contact position during fault current conditions.

15. The electromagnetic relay of claim 9 comprising mean for defaulting to an open contact position during threshold terminal-based current conditions.

16. An electromagnetic relay, the electromagnetic relay for enabling current to pass through switch termini, the electromagnetic relay comprising: a coil assembly, the coil assembly comprising a coil, a coil axis, and a C-shaped core, the coil being wound round the coil axis, the coil axis extending through the core, the core comprising core termini, the core termini being parallel to the coil axis;

a bridge assembly, the bridge assembly comprising an axis of rotation, a bridge, and an actuator assembly, the bridge comprising a medial field pathway, a lateral field pathway, and spaced transverse field pathways, the actuator assembly comprising a rotor bracket, the rotor bracket comprising a terminal end, the terminal end zigzag extending from the bridge assembly relative to the lateral field pathway, the core termini being coplanar with the axis of rotation and received intermediate the medial and lateral field pathways; and a switch assembly, the actuator assembly being cooperable with the switch assembly, the coil for creating a magnetic field, the magnetic field being directable through the bridge assembly via the core termini for imparting bridge rotation about the axis of rotation via magnetically induced torque, the bridge rotation for displacing the actuator assembly, the zigzag extended terminal end for introducing spring-based damping means intermediate the rotor bracket and actuator assembly, the displaceable actuator assembly for opening and closing the switch assembly, the closed switch assembly for enabling current to pass therethrough.

17. The electromagnetic relay of claim 16 wherein the switch assembly comprises spring-based aperture means for enhancing spring over travel, said means for enhancing the closed switch position.

18. The electromagnetic relay of claim 17 wherein the spring-based aperture means for enhancing spring over travel provide contact wiping means, said means for cleansing the switch assembly.

19. The electromagnetic relay of claim 16 comprising spring-based aperture means for damping contact vibration when switching from open to closed switch positions.

20. The electromagnetic relay of claim 16 comprising bridge-mounting means, the bridge-mounting means for enabling open face operation of the electromagnetic relay.

21. The electromagnetic relay of claim 16 comprising means for defaulting to a closed contact position during fault current conditions.

22. The electromagnetic relay of claim 16 comprising means for defaulting to an open contact position during threshold terminal-based current conditions.

23. The electromagnetic relay of claim 17 wherein the switch assembly comprises a spring assembly, the spring assembly comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements, via the second contact such that the first, second and third semi-circular aperture-defining extensions are uniform stacked, the three spring elements so configured providing the spring-based aperture means for enhancing spring over travel.

24. The electromagnetic relay of claim 19 wherein the switch assembly comprises a spring assembly, the spring assembly comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked the three spring elements so configured providing the spring-based aperture means for damping contact vibration.

25. The electromagnetic relay of claim 10 wherein the switch assembly comprises a spring assembly, the spring assembly comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for enhancing spring over travel.

26. The electromagnetic relay of claim 12 wherein the switch assembly comprises a spring assembly, the spring assembly comprising three spring elements, a first of the three spring elements comprising a first C-shaped aperture, the first C-shaped aperture defining a first semi-circular aperture-defining extension, the first C-shaped aperture being concentric about the first contact-receiving aperture, a second of the three spring elements comprising a second contact-receiving aperture and terminating in a second semi-circular aperture-defining extension, a third of the three spring elements comprising a third contact-receiving aperture, and a second C-shaped aperture, the second C-shaped aperture defining a third semi-circular aperture-defining extension, the second C-shaped aperture being concentric about the second contact-receiving aperture, the first and second C-shaped apertures being symmetrical about the longitudinal axes of the first and third spring elements, the second spring being sandwiched intermediate the first and third spring elements via the second contact such that the first, second and third semi-circular aperture-defining extensions are uniformly stacked, the three spring elements so configured providing the spring-based aperture means for damping contact vibration.

27. An electromagnetic relay assembly, the electromagnetic relay assembly for selectively enabling current to pass through switch termini, the electromagnetic relay assembly comprising:

an electromagnetic coil assembly, the coil assembly comprising a current-conductive coil, a yoke assembly, and a coil axis, the coil being wound around the coil axis and comprising first and second electromagnet-driving termini, the yoke assembly comprising first and second yoke arms, the yoke arms each comprising an axial yoke portion and a yoke terminus;

an armature assembly, the armature assembly comprising a rotor assembly and a rotor axis of rotation, the rotor assembly comprising first and second rotor magnets, a rotor plate, a rotor bracket, and a return spring, the rotor bracket comprising a terminal end, the terminal end extending laterally from the rotor assembly, the rotor magnets having like orientation and extending intermediate the rotor plate and the rotor bracket opposite the rotor axis of rotation; and a switch assembly, the switch assembly comprising first and second switch terminals and a triumvirate spring assembly, the first switch terminal comprising a first contact and a first switch terminus, the second switch terminal comprising a second switch terminus, the spring assembly comprising a second contact and three spring elements, a first spring element comprising a first C-shaped aperture, the first C-shaped aperture being concentric about the first contact-receiving aperture, the second spring element comprising a second contact-receiving aperture, the third spring element comprising a third contact-receiving aperture and a second C-shaped aperture, the second C-shaped aperture being concentric about the second contact-receiving aperture, the second spring element being sandwiched intermediate the first and third spring elements via the second contact, the first and second contacts being juxtaposed adjacent one another, the spring assembly being attached to the actuator, the yoke termini being received intermediate the rotor plate and the rotor bracket, the rotor axis of rotation being coplanar with the yoke termini, the coil for creating a magnetic field, the magnetic field being directable through the yoke termini via the rotor assembly for imparting armature rotation about the rotor axis of rotation, the rotor bracket for displacing the actuator, the laterally extended terminal end for introducing spring-based damping means intermediate the rotor bracket and actuator, the actuator for actuating the spring assembly intermediate an open position and a closed position, the closed position for enabling current to pass through the switch assembly via the first and second contacts and the switch termini, the return spring for enhancing return of the spring assembly to the open position when the coil is dormant.

28. The electromagnetic relay assembly of claim 27 wherein the C-shaped apertures provide means for enhanced spring over travel, the enhanced spring over travel for increasing contact pressure intermediate the first and second contacts when the spring assembly is in the closed position.

29. The electromagnetic relay assembly of claim 28 wherein the means for enhanced spring over travel provide means for contact wiping, the means for contact wiping for cleansing the first and second contacts.

30. The electromagnetic relay assembly of claim 27 wherein the C-shaped apertures provide means for damping contact vibration intermediate the first and second contacts when switching from the open position to the closed position.

31. The electromagnetic relay assembly of claim 27 comprising rotor mounting means, the rotor mounting means for enabling open face operation of the electromagnetic relay.

32. The electromagnetic relay assembly of claim 27 comprising closed contact default means, the closed contact default means for forcing the first and second contacts to the closed position during fault current conditions.

33. The electromagnetic relay of claim 27 comprising means for defaulting to an open contact position during threshold terminal-based current conditions.

* * * * *